United States Patent [19]

Sasao

[11] Patent Number: 4,614,847

[45] Date of Patent: Sep. 30, 1986

[54] MULTI-DIRECTION OPERATION DEVICE

[75] Inventor: Yasuo Sasao, Miyagi, Japan

[73] Assignee: Alps Electric Co., Ltd., Japan

[21] Appl. No.: 745,400

[22] Filed: Jun. 14, 1985

[30] Foreign Application Priority Data

Jun. 14, 1984 [JP] Japan ..... 59-88610[U]

[51] Int. Cl.[4] ..... H01H 25/04

[52] U.S. Cl. ..... 200/6 A; 200/153 K

[58] Field of Search ..... 200/5 R, 5 A, 6 A, 17 R, 200/153 K; 74/471 XY

[56] References Cited

U.S. PATENT DOCUMENTS 4,349,708 9/1982 Asher ..... 200/6 A 4,386,776 6/1983 Bromley ..... 200/6 A X 4,401,864 8/1983 Ichiwara ..... 200/153 K X 4,511,769 4/1985 Sahakian et al. ..... 200/6 A

FOREIGN PATENT DOCUMENTS 54-121852 9/1979 Japan ..... 200/6 A

*Primary Examiner*—J. R. Scott

*Attorney, Agent, or Firm*—Guy W. Shoup

[57] ABSTRACT

A multi-direction joystick device has an operation shaft swingable in plural directions. The operation shaft has switch-pushing arm portions extending radially from the shaft and returning elastic plates also extending radially beyond the tips of the arm portions in separation from the arm portions.

3 Claims, 5 Drawing Figures

MULTI-DIRECTION OPERATION DEVICE

FIELD OF THE INVENTION

This invention relates to a multi-direction joystick device and, particularly, to the structure of a stick control device employed as an input device of, for example, a TV personal computer.

BACKGROUND OF THE INVENTION

A conventional multi-direction joystick device will be described with reference to FIGS. 4 and 5. In these drawings, operation shaft 11 is formed of a nearly circular cylinder shape, at an end portion of which a drawing member 12 of a hemi-sphere shape is provided. At a peripheral lower end of this driving member 12 a ring-shaped working portion 13 is Provided. This working portion 13 consists of plural circular arc-shaped arm portions 13*a*, and at the center portions of these arm portions 13*a* pushing pieces 13*b* are provided projecting downward. The arm portion 13*a* is separated from the working portion 13 by a slit 13*c*, whereby the arm portion 13*a* possesses elasticity. At a center lower end of the driving member 12 a leg portion 14 of a nearly circular cone shape is provided, which is coupled to a convex portion 15*a* provided on a case 15. This case 15 is molded by synthetic resin, for example. On the case 15 plural switches 16 are distributed, and these are arranged so that the pushing pieces 13*b* of the arm portions 13*a* are positioned correspondingly above the switches 16. A cover 17 is molded by synthetic resin, for example. On this cover 17 projections 17*a* are provided so that these are positioned above the arm portions 13*a* of the working portion 13. Further, on the cover 17 a bushing 18 made of elastic material such as rubber is attached, through which the operation shaft 11 passes.

Now, the principle of operation of the foregoing structure will be described. As the operation shaft 11 is manipulated so as to incline, the driving member 12 provided on the operation shaft 11 also inclines. In response thereto, the pushing piece 13*b* of the arm portion 13*a* of the working portion 13 provided at the peripheral lower end of the driving member 12 pushes the switch 16 provided below, thereby resulting in a circuit switching. At this moment, in compliance with inclination of the driving member 12, the other arm portion 13*a'* opposing to that operated arm portion 13*a* is curved by the projection 17*a* provided on the cover 17. By the elasticity resulting from the curving of the arm portion 13*a'* the operation shaft 11 is returned to its initial state. Here, the returning spring of the operation shaft 11 and the pushing portion of the switch are formed by the same arm portion so that they exert both functions of returning and switch-pushing by being curved in opposite directions. As an example of such conventional devices as above, U.S. Pat. No. 4,349,708 is known.

As apparent from the above, the foregoing conventional device comprises the operation shaft provided swingably inside the case, the driving member attached to the operation shaft, the plural arm portions attached to the driving member, and the plural switches distributed below these are portions, and is featured in that the returning spring of the operation shaft and the pushing portion of the switch are formed by the same arm portion, and exert both functions of returning and switch-pushing by being curved in opposite directions. Accordingly, the returning force of the operation shaft and the pushing force of the switch become equal. Thus, in order to strengthen the returning force of the operation shaft, the pushing force of the switch must be increased correspondingly. Therefore, there results in the drawback that an excessive pushing force is applied to the switch, whereby the switch would be damaged or destroyed.

SUMMARY OF THE INVENTION

The multi-direction operation device according to the present invention comprises an operation shaft provided swingably, switch-pushing arm portions mounted radially on the operation shaft, and returning elastic plates mounted on the operation shaft in separation from the arm portions and extending beyond the tips of the arm portions, wherein the returning elastic plates are made so that these have elasticity independent of the switch-pushing arm portions.

In accordance with the foregoing structure, the present invention features that: the returning elastic plates of the operation shaft and the switch-pushing arm portions can have mutually independent elasticity, thus, the returning force of the operation shaft can be set strong, whereas the pushing force of the switch can be set weak. Accordingly, there occurs no damage nor destruction of the switch, and the switch can be changed over a stable action.

DETAILED DESCRIPTION OF THE INVENTION

Figure 1:
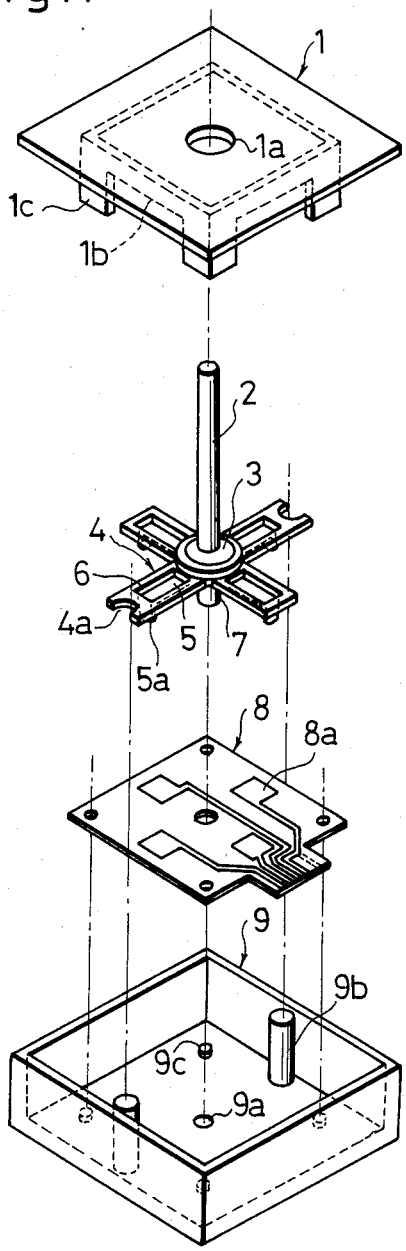
FIG. 1 is an exploded perspective view of an embodiment of a multi-direction operation device according to the present invention.
Figure 2:
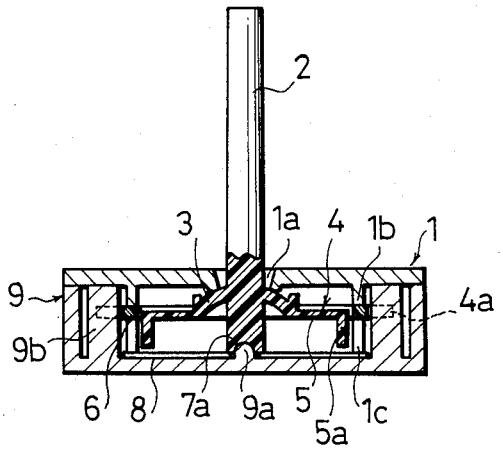
FIG. 2 is a side sectional view of the present device.
Figure 3:
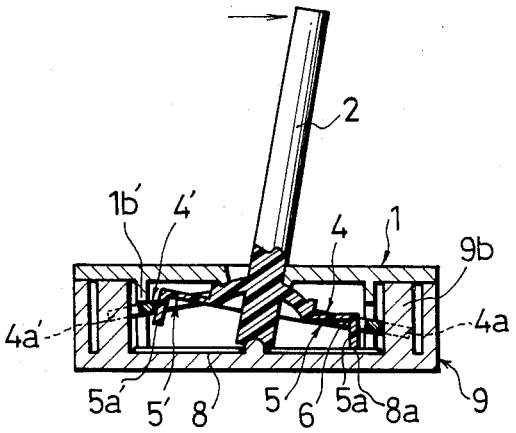
FIG. 3 is a side sectional view illustrating the operated state of the device shown in FIG. 2.
Figure 4:
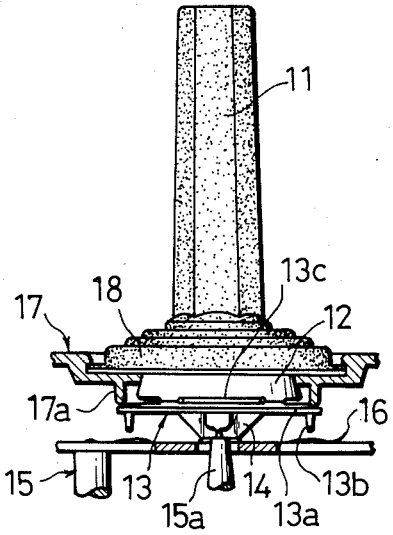
Fig. 4 PRIOR ART
FIG. 4 is a side sectional view illustrating the important portion of the conventional device.
Figure 5:
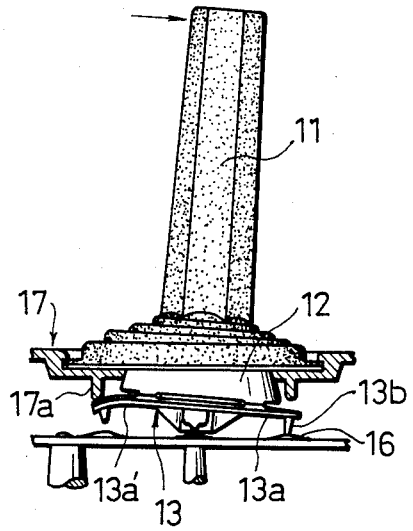
Fig. 5 PRIOR ART
FIG. 5 is a side sectional view illustrating the operated state of the device shown in FIG. 4.

The embodiment according to the present invention will be described in detail with reference to FIGS. 1 through 3. An upper case 1 is molded by synthetic resin, for example, which has a circular hole 1*a* at the center and, at its lower portion, a box-like guide plate 1*c* formed with stopper portions 1*b*. An operation shaft 2 of a circular cylinder shape including attached returning elastic plates 4 which extend crosswisely outward from a base portion 3 of a hemi-shere shape. At the center of each returning elastic plate 4 a plate-like arm portion 5 is provided, and at a lower portion of the tip of the arm portion 5 a convex pushing portion 5*a* is provided. The arm portion 5 is separated by narrow gaps 6 from the returning elastic plate 4. Thus, by these narrow gaps 6 the arm portion 5 is made so as to possess elasticity independent of the returning elastic plate 4. At two tip portions of mutually opposing wing pieces of the returning elastic plates 4 guide grooves 4*a* of a nearly semicircular shape are formed. At the center lower end of the base portion 3 a leg portion 7 of a circular cylinder shape is provided, on the under face of which a concave portion 7*a* is formed. A switch section 8 is made by a film of polyethylene for example, on which plural independent contact switch assemblies 8*a* are formed with spaced-apart depressable contact electrodes and are distributed to form a membrane-type switch. A lower case 9 is molded by synthetic resin, for example, into a box shape, on the bottom surface of which there are formed a convex portion 9*a* of a hemisphere shape at the center, rotation-preventing portions 9*b* of a circular cylinder shape at two side end positions, and convex projections 9*c* at four end positions.

Now, the principle of operation of the foregoing structure will be described. As the operation shaft 2 is manipulated so as to incline, the switch-pushing arm portion 5 provided on the operation shaft 2 also inclines. The pushing portion 5*a* of the arm portion 5 pushes the contact portion 8*a* of the switch section 8 positioned below, thereby resulting in a circuit switching. At this moment, because the arm portion 5 is separated from the returning elastic plate 4 by the narrow gaps 6, the contact portion 8*a* is pushed by an appropriate pushing pressure. On the other hand, in response to inclination of the arm portion 5, the other returning elastic plate 4' opposing to that arm portion 5 is press-abutted upon the stopper portion 1*b'* formed on the upper case 1. In turn, by the elasticity resulting from curving of the returning elastic plate the operation shaft 2 is returned to its initial state. Here, the returning elastic plate 4' functioning as a returning spring of the operation shaft 2 is operated independent of the arm portion 5' having the pushing portion 5*a'* against the switch. Thus, a proper working force can be realized. In addition, with the rotation-preventing portions 9*b* provided on the lower case 9 and the guide grooves 4*a*, 4*a'* of the returning elastic plates 4, 4' are engaged. Thus, rotation of the operation shaft is prevented and a smooth operation can be obtained.

As apparent from the foregoing description, the multi-direction operation device according to the present invention comprises the operation shaft provided swingably, the switch-pushing arm portions mounted radially on the operation shaft, the returning elastic plates mounted on the operation shaft in separation from the arm portions and extending beyond the tips of the switch-pushing arm portions, the case provided with the stopper portions for controlling swinging of the returning elastic plates, and the preventing portions provided on the case for preventing rotation of the operation shaft. In addition, the returning elastic plates are designed so that these can possess elasticity independent of the switch-pushing arm portions. Correspondingly, the returning force of the operation shaft can be set large, whereas the pushing force of the switch can be set small. Thus, the present invention produces the practical effectiveness that there occurrs no damage nor destruction of the switch and the switch can be changed over with a stable action.

While the preferred embodiment has been described, variations thereto will occur to those skilled in the art within the scope of the present inventive concepts which are delineated by the following claims.

What is claimed is:

1. A multi-direction joystick device comprising:

an upper casing provided with a central aperture for receiving an operation shaft therethrough and stopper portions defined on a lower surface thereof;

a lower casing having a floor provided with a central pivot portion and side walls on which at least two opposing rotation-preventing members are fixed;

an operation shaft received through said aperture in said upper casing and having one end thereof supported on said central pivot portion of said lower casing and its other end extending from said upper casing so as to be pivotable in any direction;

a plurality of resilient switch-pushing arms mounted on said operation shaft radially spaced apart and extending toward said side walls between said upper casing and said floor of said lower casing, and a corresponding plurality of contact switch assemblies mounted in position to be depressed by the resilient force of respective switch-pushing arms when said operation shaft is pivotally inclined in respective directions; and a plurality of resilient returning arms mounted on said operation shaft radially spaced apart and extending toward said side walls between said upper casing and said floor of said lower casing, said stopper portions on said lower surface of said upper casing being engaged by said returning arms when said operation shaft is pivotally inclined in respective directions so as to restore said operation shaft to an upright position by the resilient force of said returning arms, at least two opposing ones of said returning arms having engaging portions for engaging said at least two rotation-preventing members to prevent axial rotation of said operation shaft;

wherein said returning arms and said switch-pushing arms are separated from each other and have different resiliency characteristics such that a lesser resilient force can be applied to said switch assemblies by said switch-pushing arms than that applied on said stopper portions by said returning arms when said operation shaft is inclined.

2. A multi-direction joystick device as described in claim 1, wherein said returning arms are each formed as a plate having a central elongated slot extending to said operation shaft, and said switch-pushing arms are the same in number as said returning arms and are of smaller dimensions so as to be positioned within the elongated slots of respective returning arms separated therefrom by a gap, such that said switch-pushing arms can push respective switch assemblies independently from said returning arms when said operation shaft is inclined.

3. A multi-direction joystick device as described in claim 1, wherein said rotation-preventing members are formed as projections on said side walls which fit in said engaging portions formed as recesses on the ends of said at least two opposing returning arms having a shape corresponding to said rotation-preventing members.

* * * * *